US005636812A

United States Patent [19]

Conner et al.

[11] Patent Number: 5,636,812

[45] Date of Patent: Jun. 10, 1997

[54] DISPENSING APPARATUS

[75] Inventors: John M. Conner; Terry L. Petty, both of Roswell, Ga.

[73] Assignee: Kimberly-Clark Corporation, Neenah, Wis.

[21] Appl. No.: 700,138

[22] Filed: Aug. 20, 1996

Related U.S. Application Data

[63] Continuation of Ser. No. 402,090, Mar. 10, 1995, abandoned.

[51] Int. Cl.[6] ..... B65H 9/10

[52] U.S. Cl. ..... 242/559.2; 242/597

[58] Field of Search ..... 242/559.2, 560, 242/597

[56] References Cited

U.S. PATENT DOCUMENTS

| | | | |
|---|---|---|---|
| 1,851,722 | 3/1932 | Moore . | |
| 3,038,677 | 6/1962 | Schermerhorn . | |
| 3,294,329 | 12/1966 | Tucker et al. . | |
| 3,381,909 | 5/1968 | Tucker et al. . | |
| 3,484,052 | 12/1969 | Clarke . | |
| 3,552,669 | 1/1971 | Earnest . | |
| 3,645,060 | 2/1972 | Hammond | 53/24 |
| 3,650,487 | 3/1972 | Bahnsen . | |
| 3,694,927 | 10/1972 | Sorenson | 34/121 |
| 3,698,653 | 10/1972 | Okamura . | |
| 3,770,222 | 11/1973 | Jespersen . | |
| 3,791,603 | 2/1974 | Lenius . | |
| 4,108,389 | 8/1978 | Womack . | |
| 4,108,513 | 8/1978 | Lander . | |
| 4,222,621 | 9/1980 | Greenlee et al. . | |
| 4,362,278 | 12/1982 | Hopkinson . | |
| 4,383,657 | 5/1983 | Suh . | |
| 4,422,584 | 12/1983 | Dashnier et al. . | |
| 4,557,426 | 12/1985 | Siciliano . | |
| 4,564,148 | 1/1986 | Wentworth . | |
| 4,595,153 | 6/1986 | Goetz . | |
| 4,865,221 | 9/1989 | Jackson et al. | 221/48 |
| 5,310,129 | 5/1994 | Whittington et al. . | |

FOREIGN PATENT DOCUMENTS

| | | | |
|---|---|---|---|
| 8602194 | 3/1988 | Netherlands | 242/559.2 |
| 2245882 | 1/1992 | United Kingdom | 242/559.2 |

*Primary Examiner*—John P. Darling
*Attorney, Agent, or Firm*—Karl V. Sidor

[57] ABSTRACT

A gravity-operated apparatus for sequentially dispensing sheet material from rolls of sheet material. The apparatus includes a housing having an opening; a rotatable turret; cantilevered spindles adapted to receive a roll of sheet material; and a limit gate. Each spindle extends from a distal portion of the turret so the weight of a full roll of sheet material on the spindle urges the turret to rotate placing a full roll of sheet material at a dispensing position. The limit gate is positioned to impede rotation of the turret when the limit gate encounters a spindle containing a roll of sheet material that is less than substantially depleted.

20 Claims, 5 Drawing Sheets

DISPENSING APPARATUS

This application is a continuation of application Ser. No. 08/402,090 entitled "Dispensing Appartus" and filed in the U.S. Patent and Trademark Office on Mar. 10, 1995, now abandoned. The entirety of this application is hereby incorporated by reference.

FIELD OF THE INVENTION

The present invention relates to an apparatus for sequentially dispensing sheet material from rolls of sheet material.

BACKGROUND

It is desirable to dispense rolls of sheet material such as, for example, rolls of bathroom tissue, in a sequential manner. Dispensers that store and sequentially dispense rolls of sheet material can be used to insure that a reserve roll or rolls is available when the dispensing roll is depleted. Occasionally, this can be extremely important in situations such as, for example, public and institutional washroom facilities.

Dispensers that store and sequentially dispense rolls of sheet material have another advantage in that they do not need to be reloaded each time the dispensing roll is depleted. In the past, dispensers have been designed to contain one or more reserve rolls of material that can be used when the roll at the dispensing position is depleted. In some cases, these designs require mechanical adjustment of the dispenser by a user to gain access to a reserve roll or to have a reserve roll sequentially placed in a dispensing position. Such contact between a user and a dispenser can be undesirable, especially in settings such as public rest rooms.

Dispensers have been developed to with features that automatically advance a reserve roll into a dispensing position. Generally speaking, automatic dispensers tend to be complex, expensive and have the potential to jam. Some automatic dispensers use complex position locking mechanisms and/or springs, gears or the like. Generally speaking, these complicated features tend to be expensive, unreliable, and have the potential to jam.

Accordingly, there is a need for a simple, inexpensive apparatus for sequentially dispensing sheet material from rolls of sheet material. There is also a need for a simple, gravity-operated apparatus for sequentially dispensing sheet material from rolls of sheet material.

SUMMARY OF THE INVENTION

The problems described above are addressed by a gravity-operated apparatus for sequentially dispensing sheet material from rolls of sheet material. The apparatus includes a housing having an opening; a rotatable turret; cantilevered spindles adapted to receive a roll of sheet material; and a limit gate. Each spindle extends from a distal portion of the turret so the weight of a full roll of sheet material on the spindle (at any position other than a dispensing position) urges the turret to rotate thereby placing a full roll of sheet material at a dispensing position. The limit gate is positioned to impede rotation of the turret when the limit gate encounters a spindle containing a roll of sheet material that is less than substantially depleted.

In an aspect of the present invention, the rotatable turret may be a circular disc. In another aspect of the invention, the rotatable turret may composed of struts extending radially outward from and joined at a central point.

In an embodiment of the invention, three cantilevered spindles may extend from distal portions of the rotatable turret. During operation, it is desirable that rolls of sheet material be placed on only two of the spindles so as to create an unbalanced condition that urges the turret to rotate.

According to the invention, the sheet material may be a fibrous cellulosic material. Desirably, the sheet material is paper. More desirably, the sheet material is paper tissue. The sheet material may be wound into a coreless roll. Desirably, the sheet material is wound on a core to form a roll.

According to the invention, the turret may be attached to the housing. The housing may be composed of a front wall, a top wall, and side walls. The housing may include a pivoting cover.

The limit gate may be a limit roller or a limit pin. In some embodiments of the present invention, the limit gate may be adjustable. The limit gate may be affixed to the housing.

The present invention also contemplates a method of sequentially dispensing sheet material from rolls of sheet material.

The method includes the step of loading a first and second roll of sheet material onto adjacent spindles of the rotatable turret. According to the invention, each spindle extends from distal portions of the turret so the weight of a full roll of sheet material on the spindle (at any position other than a dispensing position) urges the turret to rotate so that a full roll of sheet material is held at a dispensing position. That is, an unbalanced condition is created by the weight of rolls of sheet material at any position other than a dispensing position such that the turret will rotate under the influence of gravity so that a full roll of sheet material is held at a dispensing position.

Rotation of the turret and the full rolls installed on the spindles affixed to the turret is impeded when the first full roll reaches a limit gate at the dispensing position.

The first roll is substantially depleted by unwinding sheet material from the roll.

Once the roll becomes substantially depleted, rotation of the turret and the remaining full roll of sheet material resumes under the influence of gravity-until the remaining full roll reaches the limit gate at the dispensing position.

DETAILED DESCRIPTION

Figure 1:
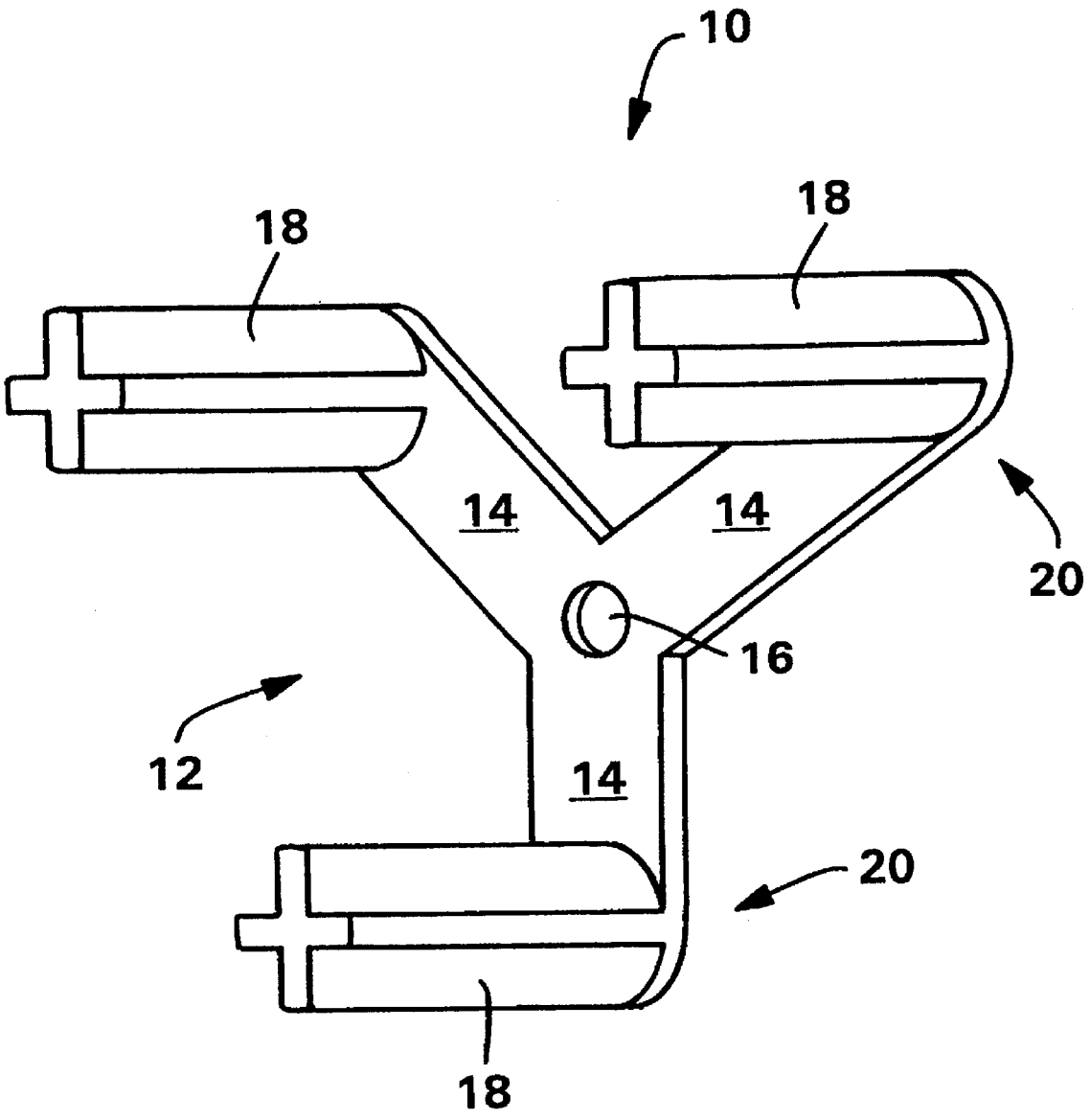
FIG. 1 is an illustration of an exemplary turret portion of an exemplary gravity-operated apparatus for sequentially dispensing sheet material from rolls of sheet material.

Referring now to the drawings and in particular FIG. 1, there is shown at 10 a portion of a gravity-operated apparatus for sequentially dispensing sheet material from rolls of sheet material. The apparatus includes a turret 12 that includes three struts 14 extending radially outward from and joined at a central point or axis 16. The turret 12 is pivotable or rotatable about the axis.

Cantilevered spindles 18 extend from the struts 14 at the distal portions 20 of the struts. The term "cantilevered" is used to describe the configuration in which the spindles are joined or united to the turret at their base. The term "distal" is used to describe locations that are far from the central point or axis 16 of the turret. The spindles 18 may be mounted or attached to the struts 14. Alternatively, the turret 12 composed of spindles 18 and struts may be formed or cast as one piece. It should be understood that other turret configurations are contemplated. For example, the turret may be a circular disc or the like having spindles extending from distal portions. The spindles themselves may be hollow, solid, cylindrical, cross-hatched or any other configuration suitable to hold a roll of sheet material. The spindles may also be rotatable or pivotable at the point where they are connected to the strut to aid in the dispensing of the sheet material from the roll.

Generally speaking, each spindle 18 extends from a distal portion 20 of the turret 12 so the weight of a full roll of sheet material on the spindle urges the turret to rotate placing a full roll of sheet material at a dispensing position. As may be seen in FIG. 2, the turret 12 is placed in an unbalanced condition by inserting two rolls of sheet material 22 and 24 on only two of the three spindles 18. That is, an unbalanced condition is created by the weight of a full roll of sheet material on the spindle at any position other than a dispensing position. In general, the spindle position on the turret directly adjacent and over the dispensing position is a desirable location to create an unbalanced condition. That unbalanced condition urges the turret to rotate under the influence of gravity toward the dispensing position 26 located at the bottom of the apparatus. Generally speaking, the term "gravity-operated" refers to an apparatus that relies on gravity as manifested in the weight of a particular component to provide some action substantially free from the aid of motors, springs or like sources to generate a force. It is generally thought that the combined weight of the turret and spindles should not be so disproportionately large (i.e., much greater than the weight of a full roll (or rolls) of sheet material) as to minimize the driving force provided by the weight of roll (or rolls) on the turret to generate rotation.

Rotation of the turret 12 and the full rolls 22 and 24 installed on the spindles 18 extending from the turret is impeded when the first full roll 22 reaches a limit gate 28 at the dispensing position 26.

Figure 3A:
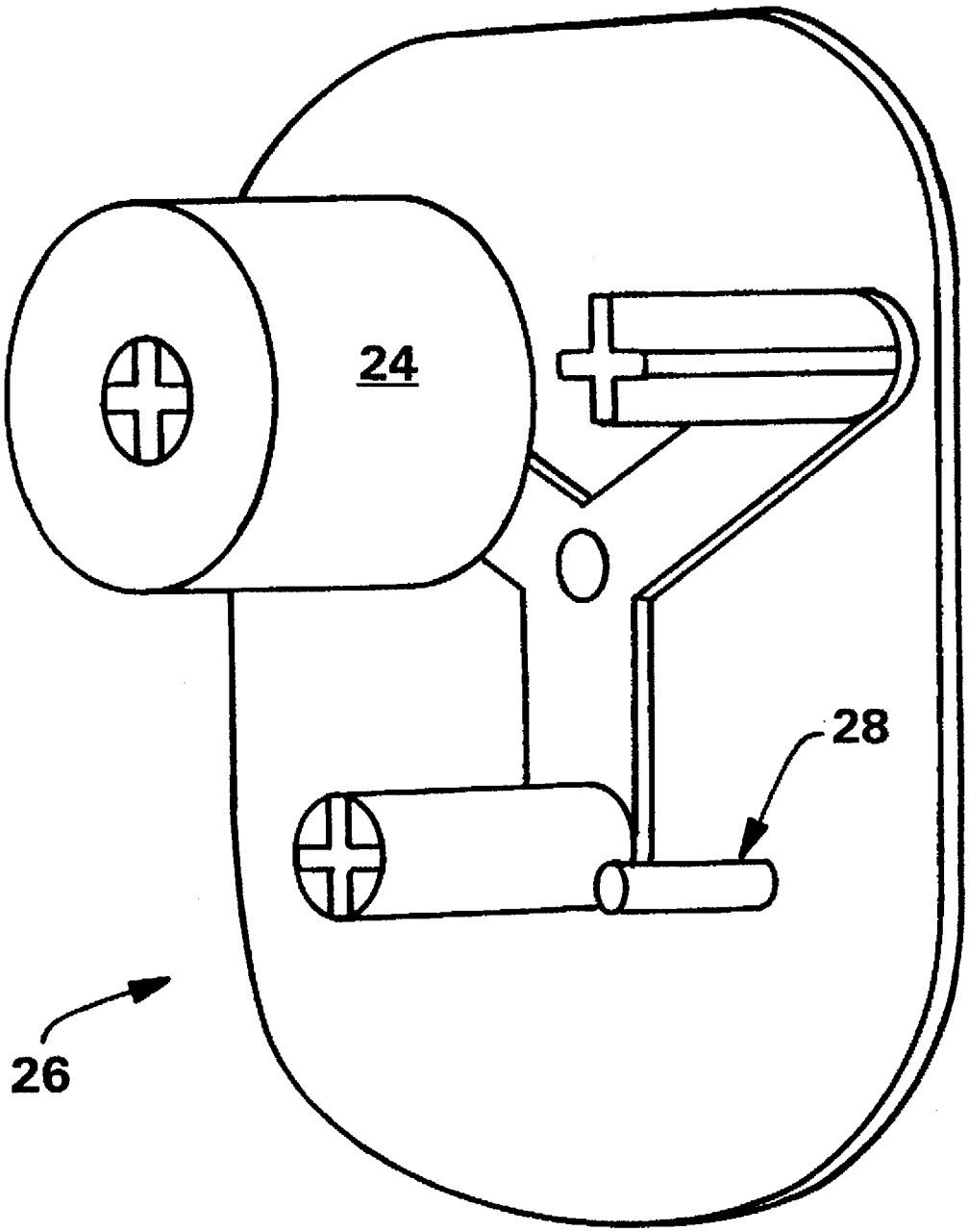
FIG. 3A is an illustration of the apparatus of FIG. 2 showing one roll of sheet material substantially depleted.
Figure 3B:
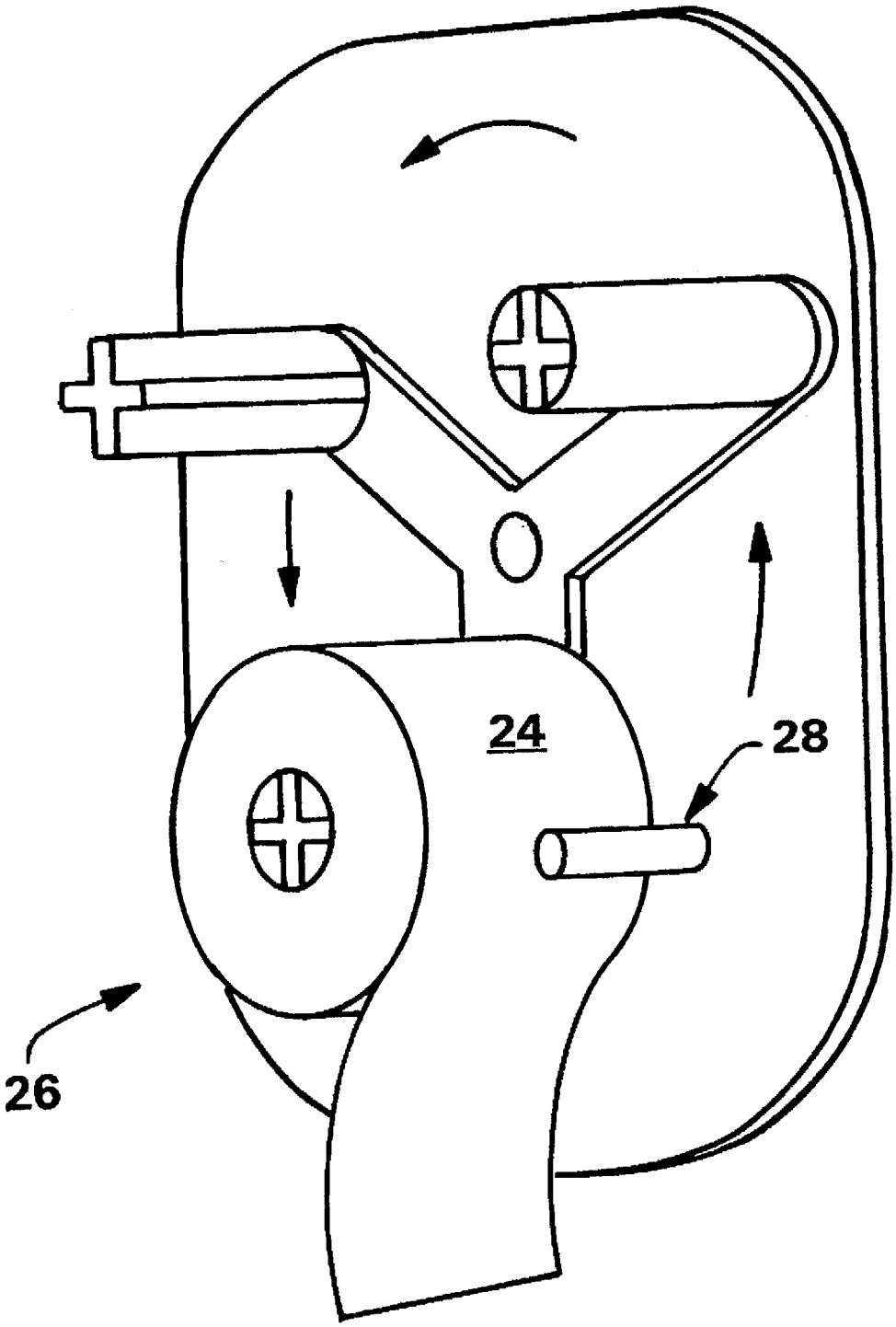
FIG. 3B is an illustration of the apparatus of FIG. 2 showing one full roll of sheet material in the dispensing position.

Referring now to FIG. 3A, the first roll 22 becomes substantially depleted by unwinding sheet material from the roll and is able to pass the limit gate. Once the first roll 22 is substantially depleted and able to pass the limit gate, rotation of the turret 12 with the remaining full roll of sheet material 24 resumes under the influence of gravity (and along the direction of the arrows shown therewith) until the remaining full roll 24 reaches the limit gate at the dispensing position as show in FIG. 3B.

Figure 2:
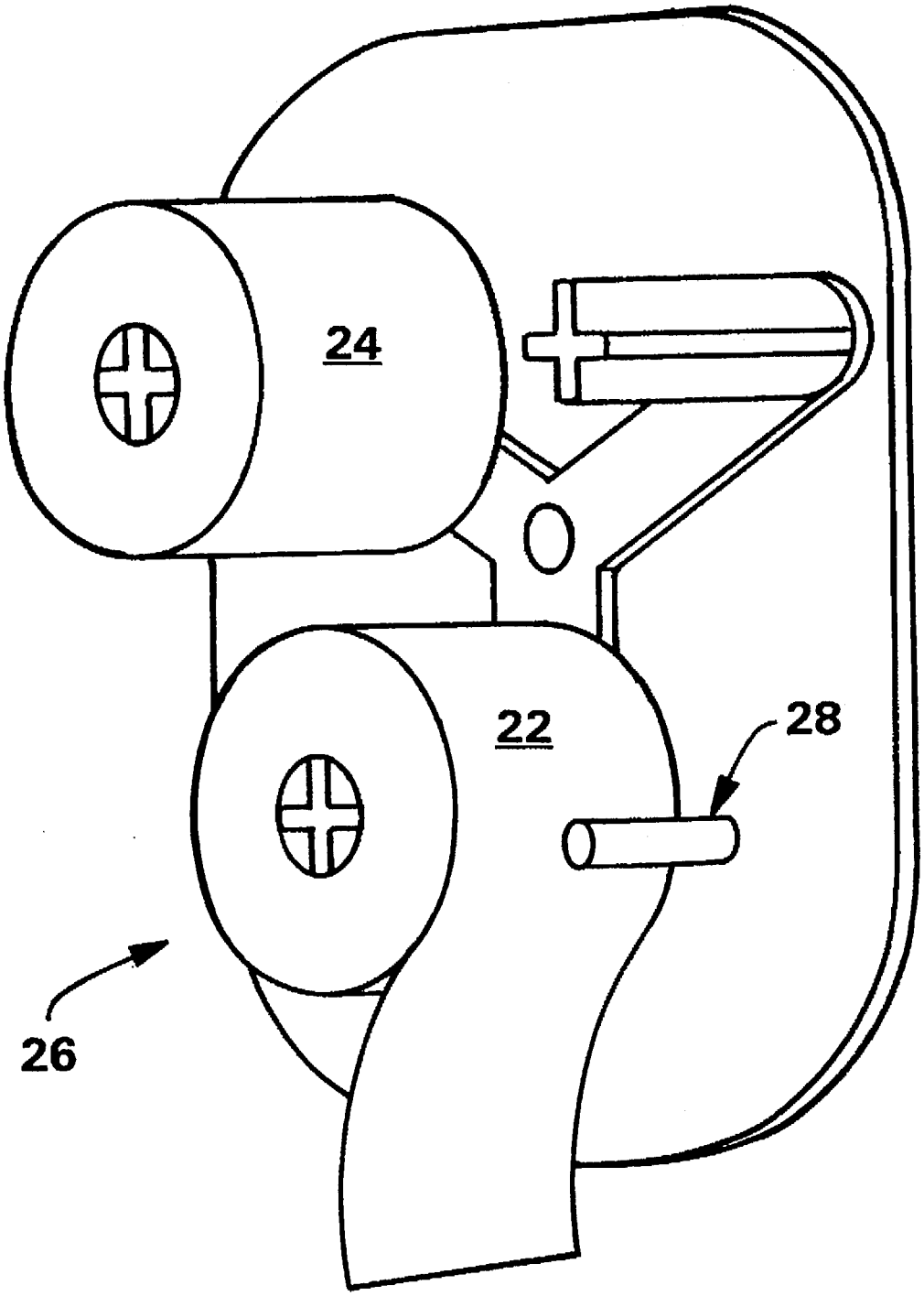
FIG. 2 is an illustration of an exemplary gravity-operated apparatus for sequentially dispensing sheet material from rolls of sheet material.

Referring to FIG. 2, the limit gate 28 is positioned to impede rotation of the turret 12 when the limit gate encounters a spindle 18 containing a roll of sheet material that is less than substantially depleted. The limit gate 28 may be a limit roller or a limit pin. The limit gate 28 may be adjustable.

Figure 4:
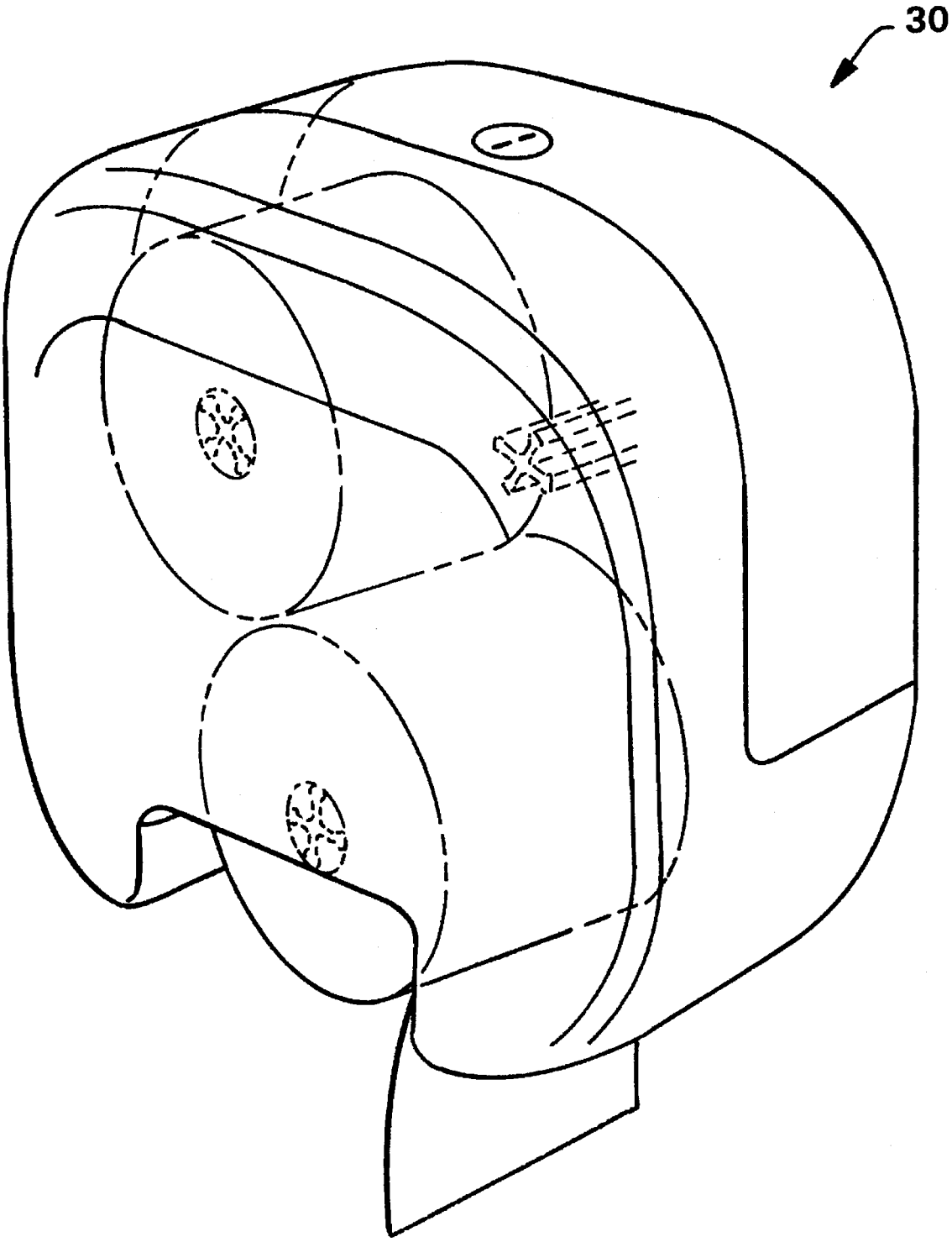
FIG. 4 is an illustration of an exemplary housing for an exemplary gravity-operated apparatus for sequentially dispensing sheet material from rolls of sheet material.

According to the invention, the apparatus for dispensing sheet material from rolls may include a housing. FIG. 4 depicts an exemplary housing at 30. The housing may be composed of a front wall, a top wall, and side walls. The housing may contain or include a pivoting cover as well as latches, hinges, locks, brackets or the like that may be found in conventional dispenser designs. In one aspect of the invention, the turret may be attached to the housing. Alternatively and/or additionally, the limit gate may be attached to the housing. It is also contemplated that the turret and/or the limit gate may be attached to a support base is connected to the housing.

In an embodiment of the invention, the housing may be configured so that only two full rolls of sheet material may be loaded onto two adjacent spindles. As may be seen in FIG. 4, the housing is configured to be much closer to the empty spindle than the spindles at the dispensing position or the reserve position. Such a configuration insures proper loading of the apparatus so that turret is unbalanced and urged to rotate by the weight of a full roll in the reserve position (i.e., position other than the dispensing position). If all three spindles were loaded with a full roll of sheet material, it is unlikely that the gravity-operated dispensing apparatus could function properly because the rolls would generally tend to balance each other.

Generally speaking, the dispensing apparatus may be used to sequentially dispense any flexible sheet material that can be wound on a roll and dispensed in individual portions. In many cases, the sheet material may be a fibrous cellulosic material such as, for example a nonwoven web of cellulosic fibers that has a structure of individual fibers which are interlaid, but not in an identifiable repeating manner. Such webs have been, in the past, formed by a variety of nonwoven manufacturing processes known to those skilled in the art such as, for example, air-forming, wet-forming and/or papermaking processes. Exemplary fibrous cellulosic materials include papers, paper tissues and the like. Such materials can be treated to impart desired properties utilizing processes such as, for example, calendering, creping, hydraulic needling, hydraulic entangling and the like. Generally speaking, the cellulosic fibrous material may be prepared from cellulose fibers from natural sources such as woody and non-woody plants. The cellulose fibers may be modified by various treatments such as, for example, thermal, chemical and/or mechanical treatments. It is contemplated that reconstituted and/or synthetic cellulose fibers may be used and/or blended with other cellulose fibers of the fibrous cellulosic material.

Desirably, the sheet material is paper. More desirably, the sheet material is paper tissue. The sheet material may be wound into a coreless roll. However, the use of a coreless roll in not required for successful operation of the present invention. In fact, in an aspect of the invention, it is desirable for the sheet material to be wound on a hollow core to form a roll.

In an embodiment of the invention, the dispenser may be configured to sequentially dispense bathroom tissue from individual rolls wound about a core. Generally speaking, the standard dimensions of such individual rolls of bathroom tissue may be about 3 to about 5 inches in width and from about 3 to about 5 inches in diameter. Accordingly, embodiments of the dispensing apparatus may have dimensions suited to hold and store standard sized rolls of bathroom tissue.

The dispensing apparatus may be manufactured from any suitable material. The entire apparatus may be made from one material or combinations of materials may be used. Exemplary materials include plastics and metals.

The method of the present invention relates to the sequential dispensing of sheet material from rolls of sheet material. The rolls may have cores or may be coreless.

Generally speaking, the method includes the step of loading rolls of sheet material onto spindles of the rotatable turret in an unbalanced matter. For example, when the rotatable turret has three spindles, a first and second roll of sheet material may be loaded onto adjacent spindles of the rotatable turret.

According to the invention, each spindle extends from distal portions of the turret so the weight of a full roll of sheet material on the spindle (at any position other than a dispensing position) urges the turret to rotate placing a full roll of sheet material at a dispensing position. That is, an unbalanced condition is created by the weight of rolls of sheet material at any position other than a dispensing position so that the turret will rotate under the influence of gravity to place a full roll of sheet material at a dispensing position.

It is contemplated that the rotatable turret could have more than three spindles (e.g., four or more spindles) as long as the spindles were at positions such that loading full rolls of sheet material on at least one spindle other than at the dispensing position produced an unbalanced condition that urges the turret to rotate.

Rotation of the turret and the full rolls installed on the spindles affixed to the turret is impeded when the first full roll reaches a limit gate at the dispensing position.

The first roll is depleted by unwinding sheet material from the roll. As the first roll becomes substantially depleted, it is finally able to slip past the limit gate and rotation of the turret and the remaining full roll of sheet material resumes under the influence of gravity until the remaining full roll reaches the limit gate at the dispensing position. The substantially depleted roll, being much lighter, is rotated upward and out of the way.

Reloading of the dispensing apparatus is accomplished by opening the housing or cover, disposing of the depleted core, if any, and loading a new reserve roll on the spindle at the reserve position. In order to simplify proper loading, it is desirable that the housing or cover be configured so that full rolls of sheet material can be loaded onto a spindle (or spindles) at the reserve position (or reserve positions). This may be accomplished by placing baffles or a blocking device at the non-reserve position (or positions) and/or configuring the housing so there is insufficient clearance around a spindle at the non-reserve position (or positions) to hold a spindle.

While the present invention has been described in connection with certain embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A gravity-operated apparatus for sequentially dispensing sheet material from rolls of sheet material, the apparatus comprising:

a rotatable turret;

cantilevered spindles adapted to receive a roll of sheet material, each spindle extending from a distal portion of the turret so the weight of a full roll of sheet material on the spindle urges the turret to rotate placing a full roll of sheet material at a dispensing position;

a limit gate positioned to impede rotation of the turret when the limit gate encounters a spindle containing a roll of sheet material that is less than substantially depleted; and a housing having an opening that defines said dispensing position, said housing being configured about the rotatable turret and spindles to define at least one reserve position able to contain a full roll of sheet material on a spindle and at least one non-reserve position into which a full roll of sheet material on a spindle cannot fit.

2. The apparatus of claim 1, wherein the rotatable turret includes three cantilevered spindles.

3. The apparatus of claim 1, wherein the limit gate is a limit roller.

4. The apparatus of claim 1, wherein the limit gate is a limit pin.

5. The apparatus of claim 1, wherein the limit gate is adjustable.

6. The apparatus of claim 1, wherein the limit gate is affixed to the housing.

7. The apparatus of claim 1, wherein the turret comprises a circular disc.

8. The apparatus of claim 1, wherein the turret comprises struts extending radially outward from and joined at a central point.

9. The apparatus of claim 1, wherein the turret is attached to the housing.

10. The apparatus of claim 1, wherein the housing comprises a front wall, a top wall, and side walls.

11. The apparatus of claim 1, wherein the housing includes a pivoting cover.

12. A gravity-operated apparatus for sequentially dispensing sheet material from rolls of sheet material wound on cores, the apparatus comprising:

a rotatable turret;

three cantilevered spindles adapted to receive a roll of sheet material, each spindle extending from a distal portion of the turret so the weight of a full roll of sheet material on the spindle urges the turret to rotate placing a full roll of sheet material at a dispensing position;

a housing having an opening that defines said dispensing position, said housing being configured about the rotatable turret and spindles to define a reserve position able to contain a full roll of sheet material on a spindle and a non-reserve position into which a full roll of sheet material on a spindle cannot fit; and a limit gate affixed to the housing and positioned to impede rotation of the turret when the limit gate encounters a spindle containing a roll of sheet material that is less than substantially depleted.

13. The apparatus of claim 12, wherein the turret comprises a circular disc.

14. The apparatus of claim 12, wherein the turret comprises struts extending radially outward from and joined at a central point.

15. The apparatus of claim 12, wherein the turret is attached to the housing.

16. The apparatus of claim 12, wherein the housing comprises a front wall, a top wall, and side walls.

17. The apparatus of claim 12, wherein the housing includes a pivoting cover.

18. A gravity-operated apparatus for sequentially dispensing tissue from rolls of tissue wound on cores, the apparatus comprising:

a rotatable turret comprising struts extending radially outward from and joined at a central point;

three cantilevered spindles adapted to receive a roll of tissue, each spindle extending from distal portions of the turret so the weight of a full roll of tissue on the spindle urges the turret to rotate placing a full roll of tissue at a dispensing position;

a housing having an opening that defines said dispensing position, said housing being configured about the rotatable turret and spindles to define a reserve position able to contain a full roll of sheet material on a spindle and a non-reserve position into which a full roll of sheet material on a spindle cannot fit; and a limit gate affixed to the housing and positioned to impede rotation of the turret when the limit gate encounters a spindle containing a roll of tissue that is less than substantially depleted.

19. The apparatus of claim 18, wherein the turret is attached to the housing.

20. The apparatus of claim 18, wherein the housing includes a pivoting cover.

* * * * *